US006250009B1

(12) United States Patent
Leontuk

(10) Patent No.: US 6,250,009 B1
(45) Date of Patent: Jun. 26, 2001

(54) GUN BRACE

(76) Inventor: Michael I. Leontuk, 3219 Whitehall Rd., Anderson, SC (US) 29624

( * ) Notice: Subject to any disclaimer, the term of this patent is extended or adjusted under 35 U.S.C. 154(b) by 0 days.

(21) Appl. No.: 09/342,668

(22) Filed: Jun. 29, 1999

(51) Int. Cl.[7] ..... F41A 27/22; F41C 23/08; F41C 23/12; F41C 23/14

(52) U.S. Cl. ..... 42/72; 42/94

(58) Field of Search ..... 42/71.01, 72, 94, 42/73

(56) References Cited

U.S. PATENT DOCUMENTS

| | | | | |
|---|---|---|---|---|
| 46,365 | | 2/1865 | Kinman . | |
| 1,569,901 | | 1/1926 | Virdin . | |
| 1,883,465 | | 10/1932 | Balmer . | |
| 2,441,487 | | 5/1948 | Howard | 42/72 |
| 3,209,481 | | 10/1965 | Gilbert | 42/71 |
| 3,324,588 | | 6/1967 | Gilbert | 42/71 |
| 3,665,632 | | 5/1972 | Ford | 42/71 R |
| 4,296,566 | * | 10/1981 | Campos | 42/71 R |
| 4,790,095 | * | 12/1988 | Campos | 42/73 |
| 4,843,749 | * | 7/1989 | Griffith | 42/72 |
| 5,056,253 | | 10/1991 | Willumsen | 42/94 |

FOREIGN PATENT DOCUMENTS

| | | | | |
|---|---|---|---|---|
| 9178 | | 10/1879 | (DE) | 42/71.01 |
| 14863 | | 9/1916 | (GB) | 42/106 |
| 8102925 | * | 10/1981 | (WO) | 42/72 |

* cited by examiner

*Primary Examiner*—Michael J. Carone
*Assistant Examiner*—Kyonytaek K. Mun
(74) *Attorney, Agent, or Firm*—Leatherwood Walker Todd & Mann, P.C.

(57) ABSTRACT

A brace for use by a shooter to brace a gun having an elongated stock and a butt portion. The brace includes a generally upright member connected to the stock of the gun and is configured for contacting the back portion of the user's head or neck and for bracing the gun there against while the user holds the butt of the gun against the user's shoulder. A telescoping arm is pivotally connected to the stock of the firearm adjacent the butt of the gun. The arm is pivotable between a retracted position adjacent the stock and an extended, operable position above the stock. A brace pad is connected to the end of the arm, and the brace pad is spring-biased to pivot outwardly for contacting the back of the user's head or neck.

17 Claims, 9 Drawing Sheets

GUN BRACE

BACKGROUND OF THE INVENTION

This invention relates generally to a brace for supporting and steadying a firearm.

When shooting a firearm such as a rifle or a shotgun, the shooter ordinarily brings the butt of the rifle against his or her shoulder and then sights in on a target. The firearm typically includes at least one sight positioned on or near the barrel of the gun. In most instances, a sight is carried both at the tip of the barrel, adjacent the bore opening, and at the rearward end of the barrel. The process of aiming involves a simultaneous alignment of both the front and rear sights on the target. Additionally, a scope may be used having a set of cross-hairs, or reticle, for use in aiming the firearm.

In firing the firearm, it is important that the shooter maintain the firearm absolutely steady while maintaining the sight picture through the scope and/or sights. However, because of the weight of the firearm, the time necessary to develop the sight picture, tension, fear, etc., it is oftentimes difficult to hold the firearm steady for the length of time necessary to squeeze the trigger and fire.

Thus, it would be desirable to have means for assisting the shooter and steadying the rifle while preparing to fire. Devices have been patented which attempt to assist the shooter. For example, U.S. Pat. No. 46,365, issued to Kinman, a device for supporting the shooter's arm, the device being strapped around the user's body. U.S. Pat. No. 1,569,901, issued to Virdin, discloses a firearm attachment having a supplemental stock for engaging the shoulder opposite the shoulder against which the butt of the gun is placed. U.S. Pat. No. 2,441,487, issued to Howard, discloses a similar device for bracing the gun against the shoulder opposite to the shoulder on which the butt of the gun is placed.

U.S. Pat. No. 3,209,481, issued to Gilbert, discloses a device on a gun stock for engaging the rear portion of the shooter's arm. U.S. Pat. No. 3,324,588, also issued to Gilbert, discloses use of a crooked member for engaging the rear portion of the user's arm, adjacent to the armpit.

U.S. Pat. No. 3,665,632, issued to Ford, discloses a firearm shoulder support for resting on the upper portion by the shooter's shoulder.

While the foregoing designs are known, there still exists a need for a low profile, easy to use brace for a gun.

SUMMARY OF THE INVENTION

It is, therefore, the principal object of this invention to provide a brace for supporting and steadying a firearm and a method for its use Another object of the present invention is to provide a gun brace which may be temporarily or permanently attached to a variety of different styles and models of guns.

Still another object of the present invention is to provide a gun brace which can be selectively used once attached to a gun.

Yet another object of the present invention is to provide a gun brace which is readily adjustable.

A further object of the present invention is to provide a gun brace which can be moved between an extended, ready-to-use position and a low profile retracted position.

Generally, the present invention includes a brace for use by a shooter with a gun having an elongated stock and a butt portion. The brace includes a generally upright member connected to the stock of the gun and is configured for contacting the back portion of the user's body, such as the user's head, back, or neck and for bracing the gun there against while the user holds the butt of the gun against a front portion of the user's body, such as the user's shoulder.

More specifically, the present invention includes the brace member being connected to the stock portion for movement between an extended position for contacting the back of the user's head and a retracted position adjacent the stock portion.

Further, the brace member includes a brace pad pivotally connected to the brace member for contacting the back of the user's head. The brace pad is spring-biased for automatically pivoting to a position for contacting the back of the user's head when the brace member is moved to the extended position.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
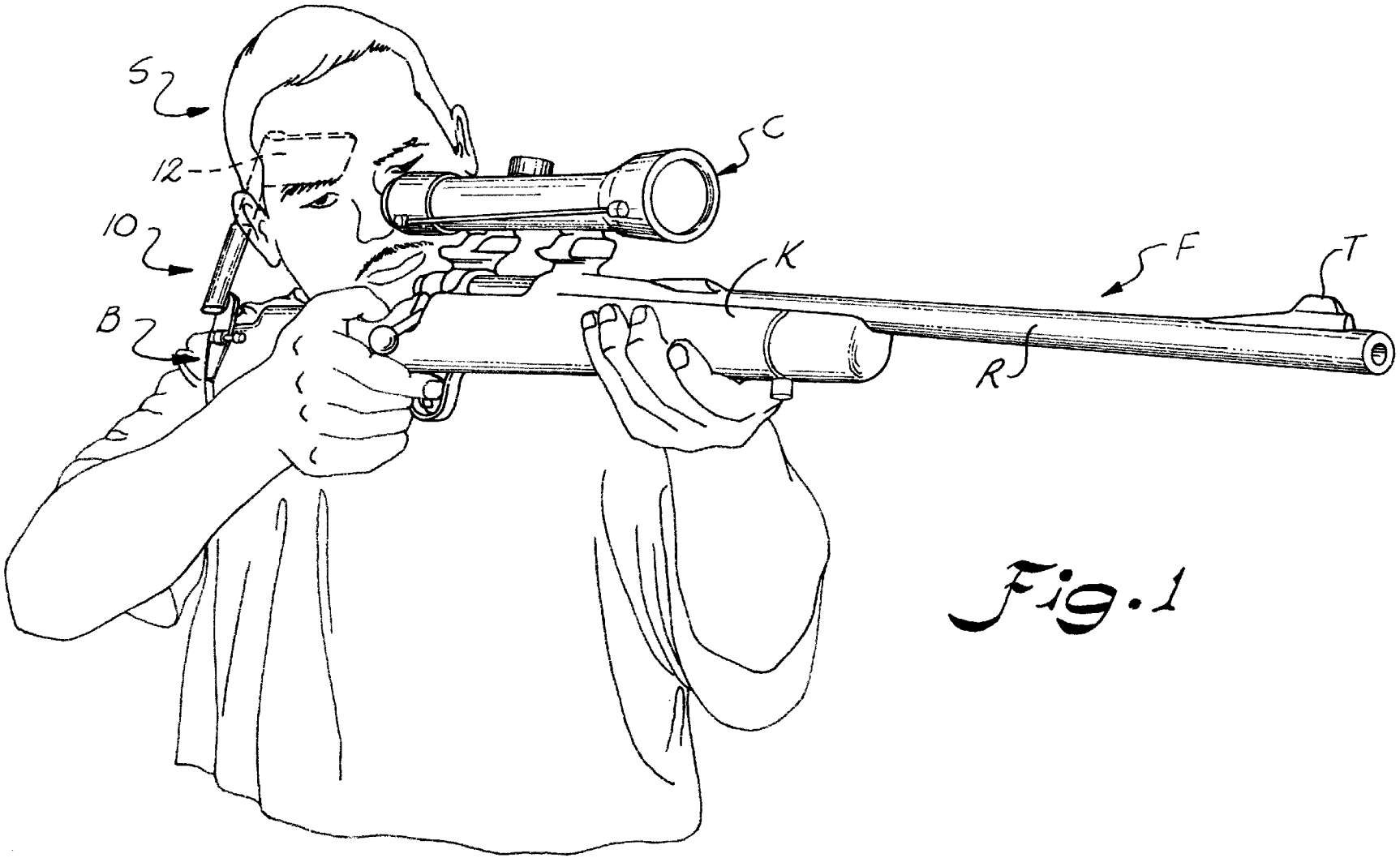
FIGS. 1 and 2 are perspective views of a gun brace constructed in accordance with the present invention being used by a shooter.

The accompanying drawings and the description which follows set forth this invention in its preferred embodiment. However, it is contemplated that persons generally familiar with guns will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the gun brace of the present invention is indicated generally in the figures by reference character 10.

The gun brace of the present invention provides means for supporting and steadying a firearm, such as a rifle or shotgun, by using the shooter's head and/or neck. This allows for the firearm to be held more stable during aiming, and also takes some portion of the firearm's weight off of the shooter's arms while aiming and firing. Thus, gun brace 10 can enable a shooter to use his or her arms and head and/or neck area together to steady the firearm while aiming. Another function of gun brace 10 is to provide a fixed place for the shooter's head while aiming. The fixed, consistent place against which the shooter may rest his or her head while aiming the firearm is anticipated to improve accuracy in aiming and also decrease the time required for the shooter to take aim and fire, particularly in repetitive firing situations. Gun brace 10 should also aid shooters in aiming from awkward positions, which may be the case, for example, with a deer hunter sitting in a tree stand.

Figure 2:
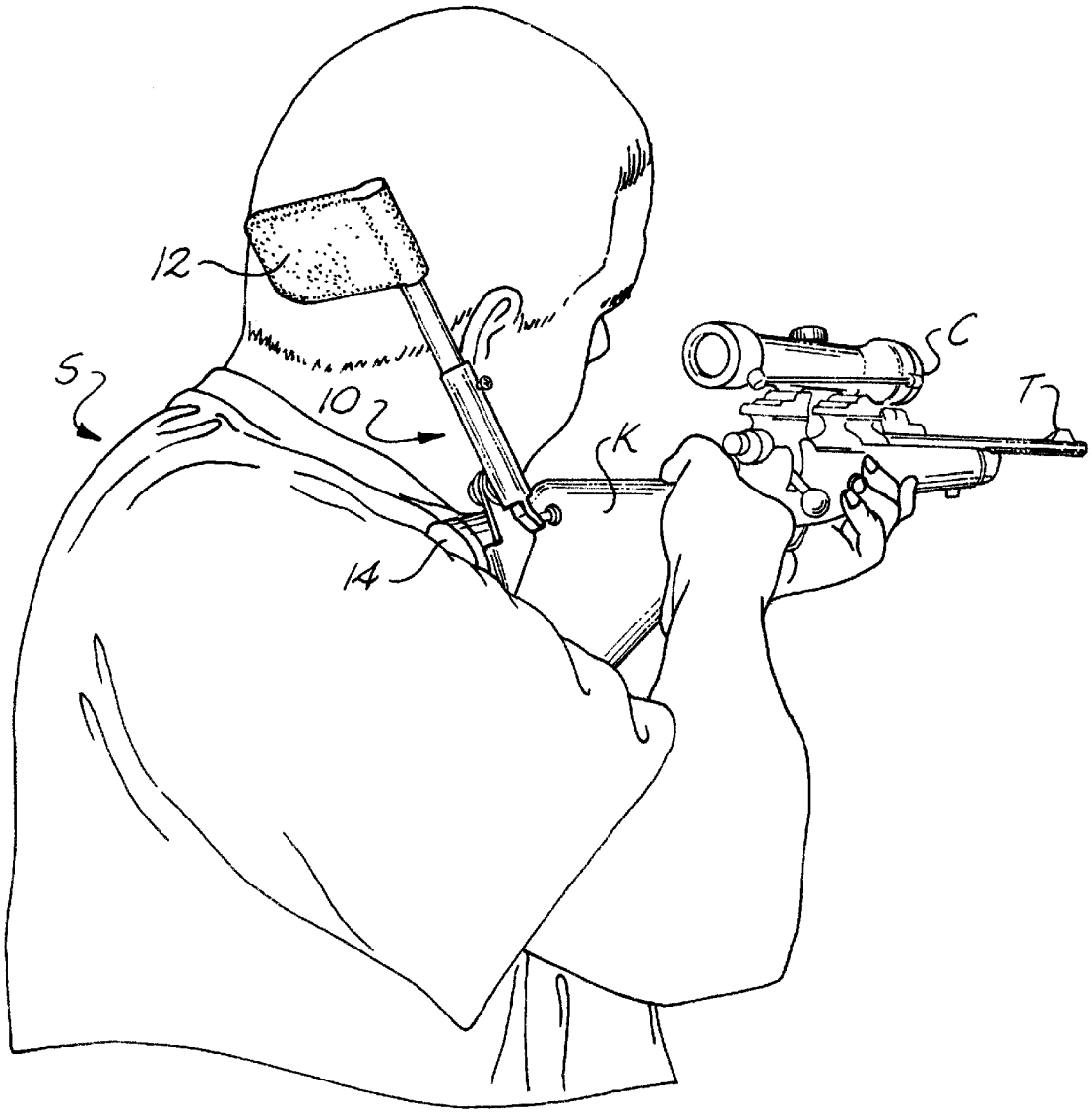

Turning to FIG. 1, gun brace 10 is shown mounted on a conventional firearm F, which in this instance is a rifle. FIG. 1 illustrates the shooter S taking aim at a target (not shown). Gun brace 10 is in an extended, operable position extending above the butt B of stock K of firearm F, with brace pad 12 being shown in phantom behind the shooter's head. Firearm F includes a scope C and front sight T, mounted on barrel R. FIG. 2 illustrates a view of the same shooter as shown in FIG. 1, from the rear. Brace pad, or support, 12 is shown contacting the back of shooter's head and a butt plate 14 of rifle butt B bearing against the front surfaces of the shooter's shoulder/chest area.

Figure 3:
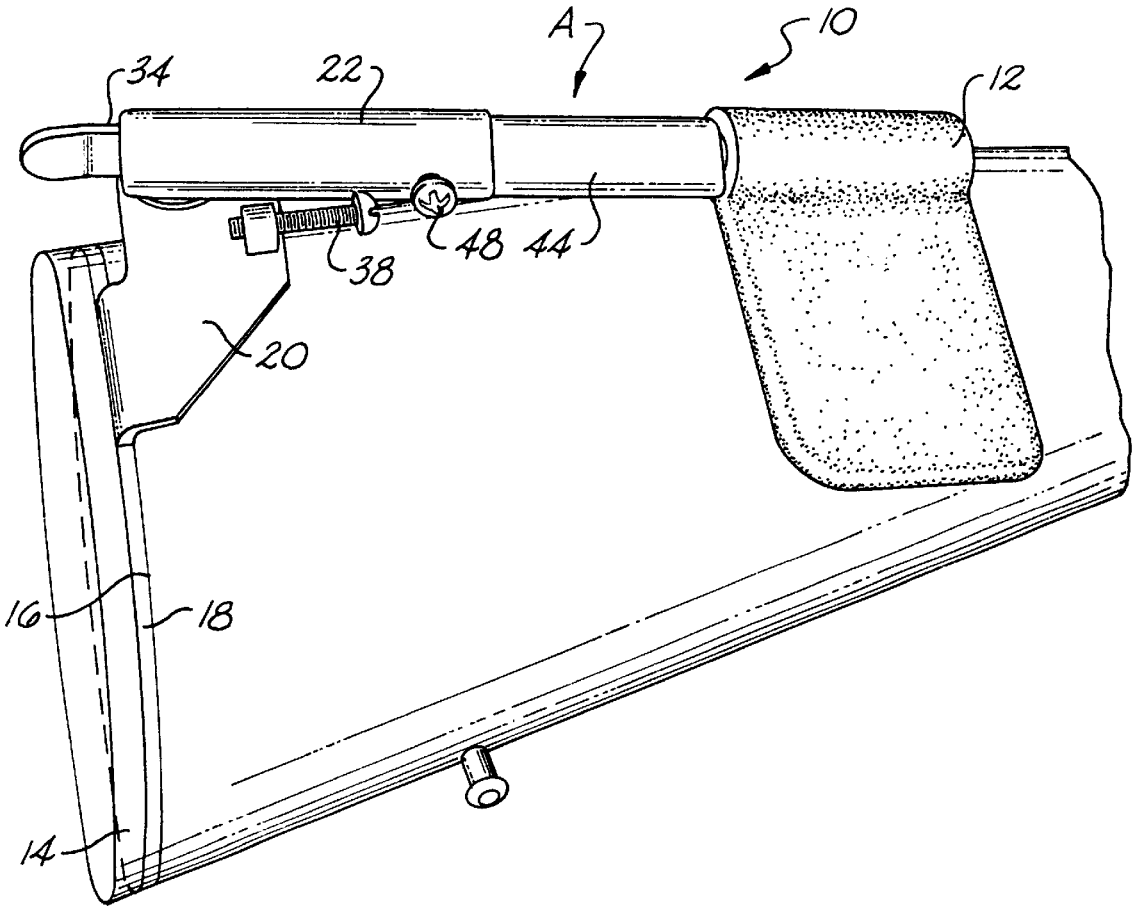
FIG. 3 is a partial side elevational view of a gun brace constructed in accordance with the present invention showing the gun brace in a retracted position and mounted on a conventional gun stock.
Figures 4A, 4B:
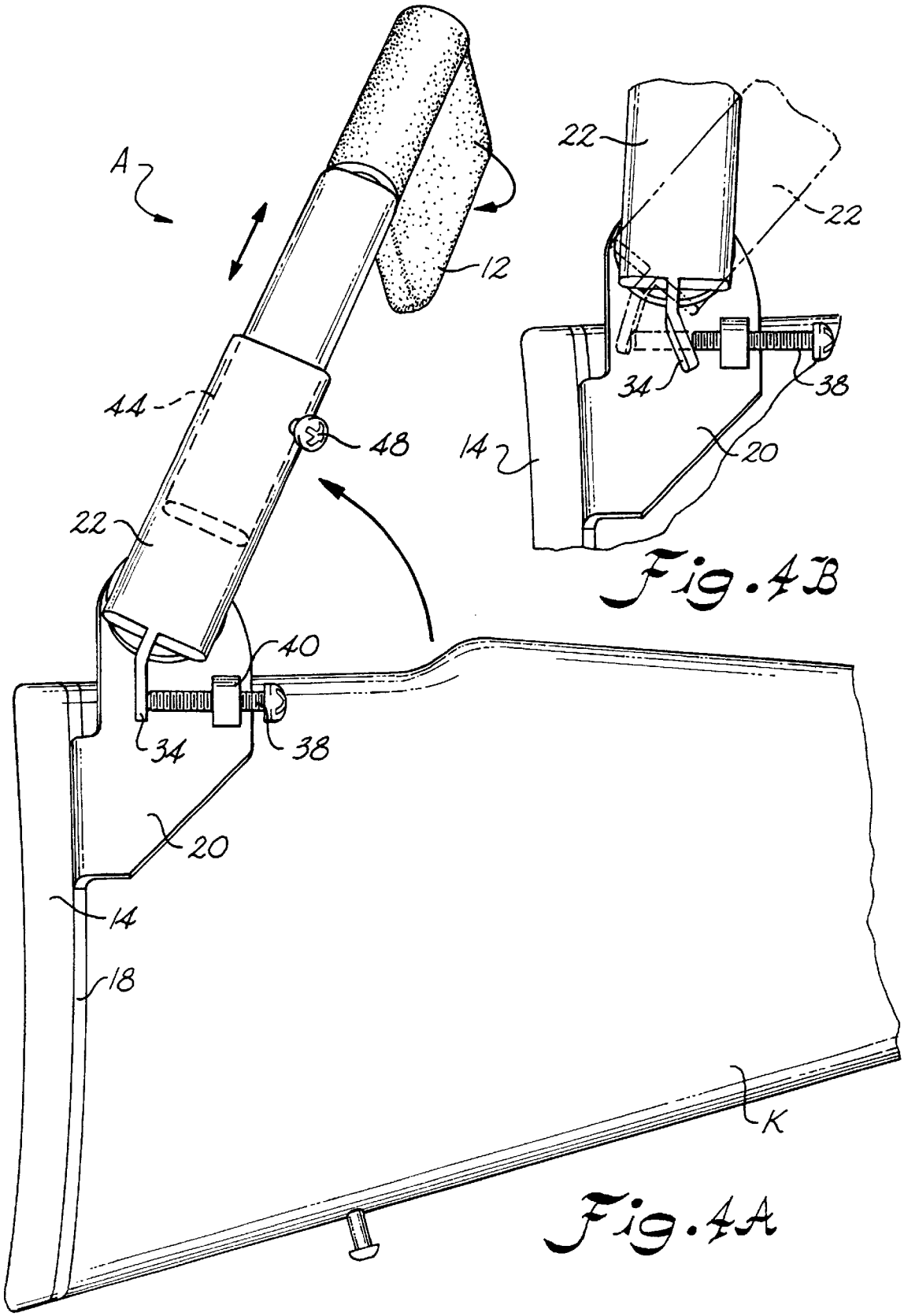
FIG. 4A is a partial side elevational view of a gun brace constructed in accordance with the present invention showing the gun brace between a retracted position and an extended position.
FIG. 4B is an enlarged partial side elevational view of a gun brace constructed in accordance with the present invention showing the gun brace between a retracted position and an extended position and showing an adjustment mechanism.
Figure 5:
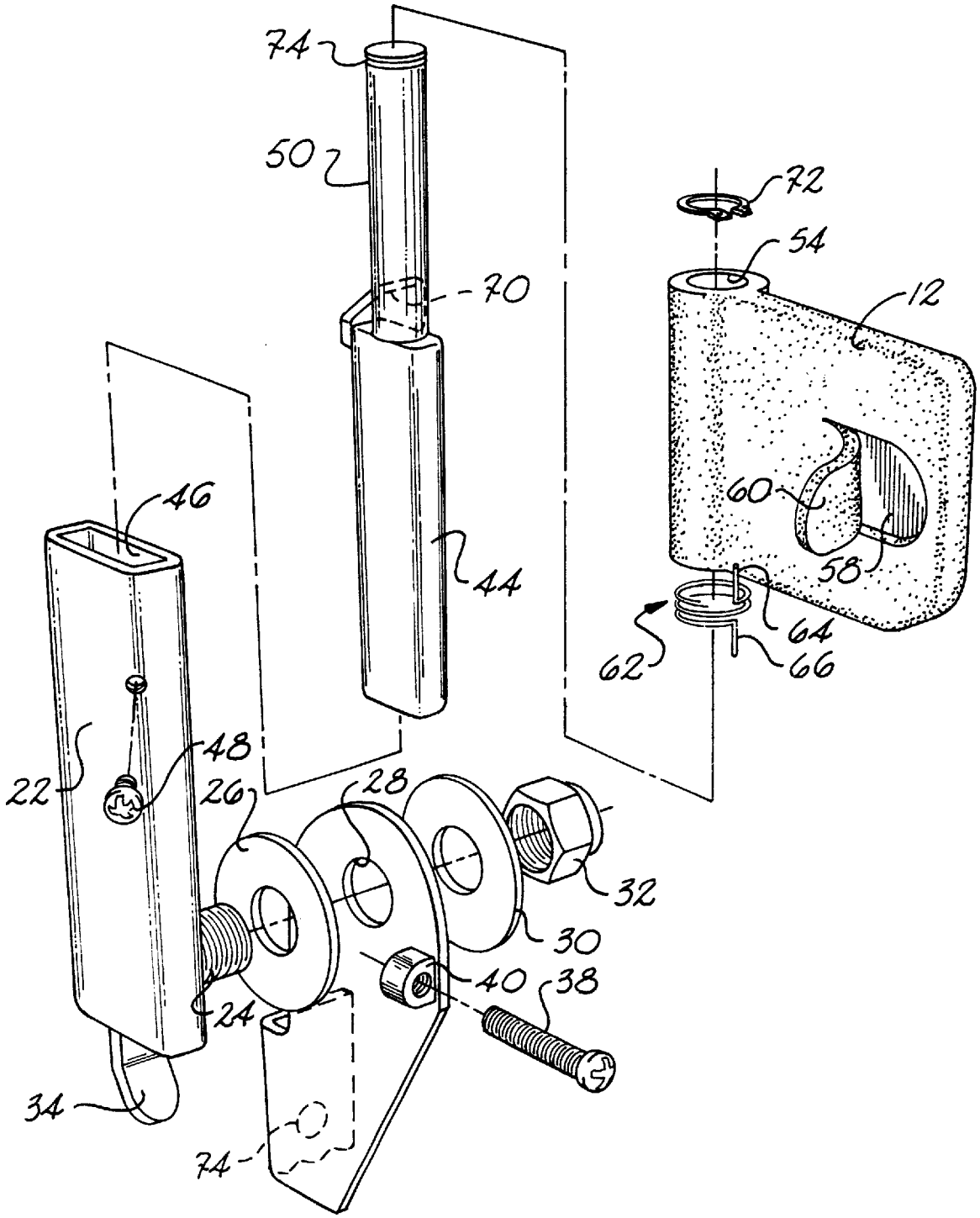
FIG. 5 is an exploded view of a gun brace constructed in accordance with the present invention.

As shown in FIGS. 3, 4A, and 4B gun brace 10 is attached between butt plate 14 and the extreme end 16 of rifle stock K with a mounting plate 18. Extending outwardly and at generally right angle to mounting plate 18 is a flange 20. Pivotally attached to flange 20 is an arm, generally A, lower arm position, or sleeve, 22. Lower arm 22 includes, as shown in FIG. 5, an outwardly extending threaded rod 24 which extends through a washer 26. Washer 26 is preferably constructed of plastic, such as nylon, or some other material to allow ease of pivoting of arm portion 22 with respect to flange 20. Threaded rod 24 extends through a bore 28 in flange 20 through a conventional washer 30, and is held for pivoting movement by nut 32.

As shown in FIGS. 4A and 4B, lower arm 22 includes a downwardly extending tang 34 which serves to limit pivoting of arm A to a predetermined extent by virtue of an adjustment screw 38 carried within a threaded boss 40, attached to flange 20. By advancing adjustment screw 38 inwardly into boss 40, the degree by which arm A may be pivoted upwardly from a retracted position (as shown in FIG. 3) is limited, and conversely, the further adjustment screw 38 is backed out of boss 40, the further arm A may be pivoted from its retracted position.

FIG. 5 further illustrates an upper member, or arm, 44 which is received within channel 46 of sleeve 22. The upper member 44 is fixed within sleeve 22 by tightening of set screw 48 there against. Because upper member 44 is moveable in channel 46, telescoping movement of upper member 44 with respect to lower arm 22 is allowed, and the extent by which a post 50 of upper member 44 extends upwardly from sleeve 22 can be adjusted, using set screw 48.

Pivotally attached to post 50 is support, or brace pad 12. Brace pad 12 includes bore 54 for receipt of post 50. Brace pad 12 is preferably constructed of a rigid plate 58, which can be plastic, metal, wood, or other suitable material, and is provided with a padded cover 60 (a portion of which is shown pulled away from plate 58 for illustrative purposes), constructed of material such as foam, cloth, rubber, leather, plastic, or some other suitable material. A torsion spring 62 encircles post 50 and includes legs 64, 66. Leg 66 of torsion spring 62 bears against upper member 44, while leg 64 bears against brace pad 12. Torsion spring 62 serves to maintain brace pad 12 in a "use" position, which is generally perpendicular to flange 20. This allows brace pad 12 to automatically move to a bracing position as arm A is moved from the retracted to the extended position.

A stop 70 is provided on upper member 44 for limiting pivoting of brace pad 12 to the position necessary for bracing the firearm against the back of the shooter's head or neck. Finally, a snap ring 72 is provided for receipt in groove 74 of post 50 in order to retain brace pad 12 thereon.

Gun brace 10 is designed for attachment to a conventional firearm. The brace 10 includes holes 74 provided in mounting plate 18 to attach gun brace 10 to a firearm F. To install brace 10 on a conventional firearm, the butt plate 14 of the firearm would simply be removed, with the mounting plate 18 being installed in its place. The butt plate 14 would then be reinstalled on top of mounting plate 18 using the same bolts, screws 76 (FIG. 6), or attachment means that would normally hold butt plate 14 in place.

Figure 6:
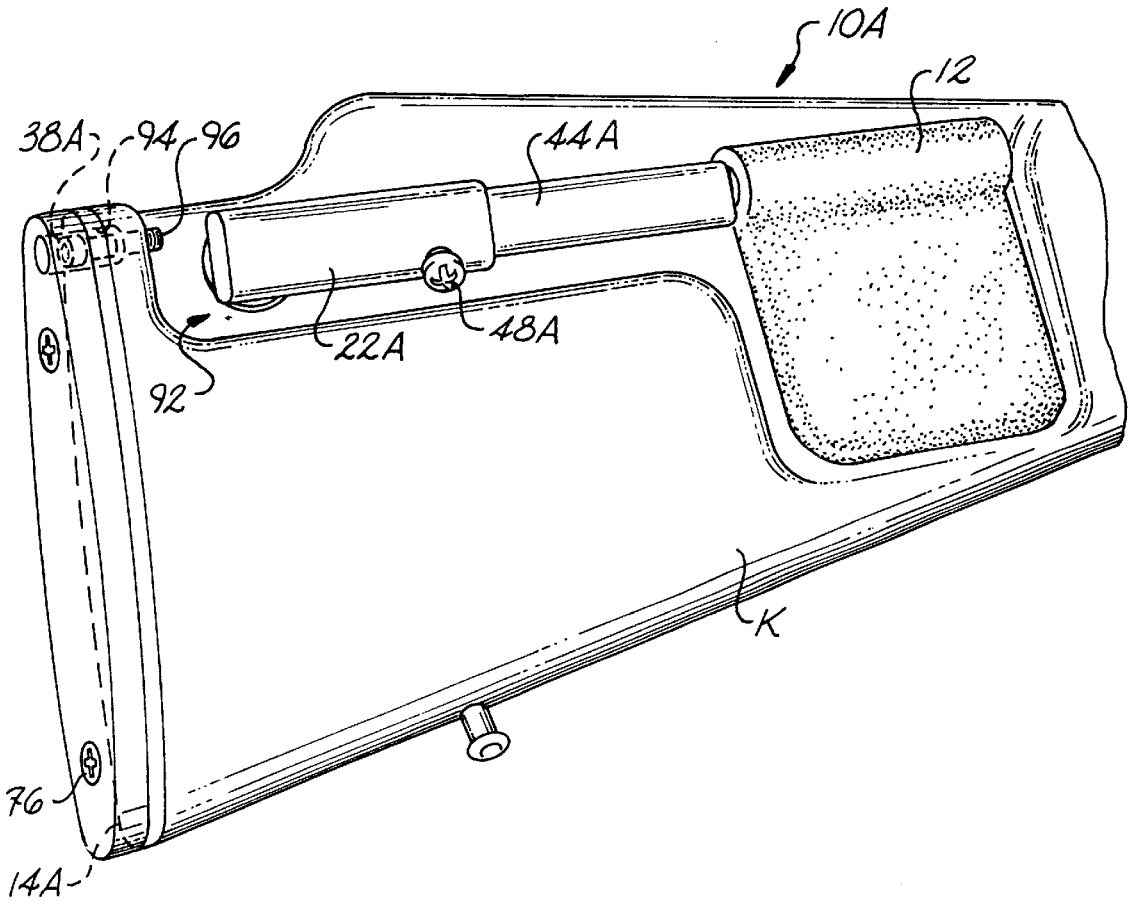
FIG. 6 is a partial side elevational view of a gun brace constructed in accordance with the present invention showing the gun brace in a retracted position and mounted on a gun stock designed for use with the present gun brace.

An alternate embodiment of the gun brace of the present invention is illustrated in FIG. 6. Gun brace 10A is built into the stock of the firearm. A recessed area, generally 92, is provided for receiving gun brace 10A when gun brace 10A is in a retracted position, such as shown in FIG. 6. Adjustment screw 38A is provided in a bore 94 in the butt plate 14A of firearm F and includes a threaded portion 96 which bears against lower arm 22A when gun brace 10A is in an extended position, thereby allowing adjustment of the extent of upward pivoting of gun brace 10A. Set screw 48A allows for adjustment of the amount by which upper arm 44A extends from lower arm 22A. As can be seen from this embodiment, when gun brace 10A is in its retracted position, it provides a more flush profile with respect to the stock of the firearm, than would typically be the case with gun brace 10, since gun brace 10 is designed for general universal mounting (and dismounting) from a conventional firearm.

Figure 7:
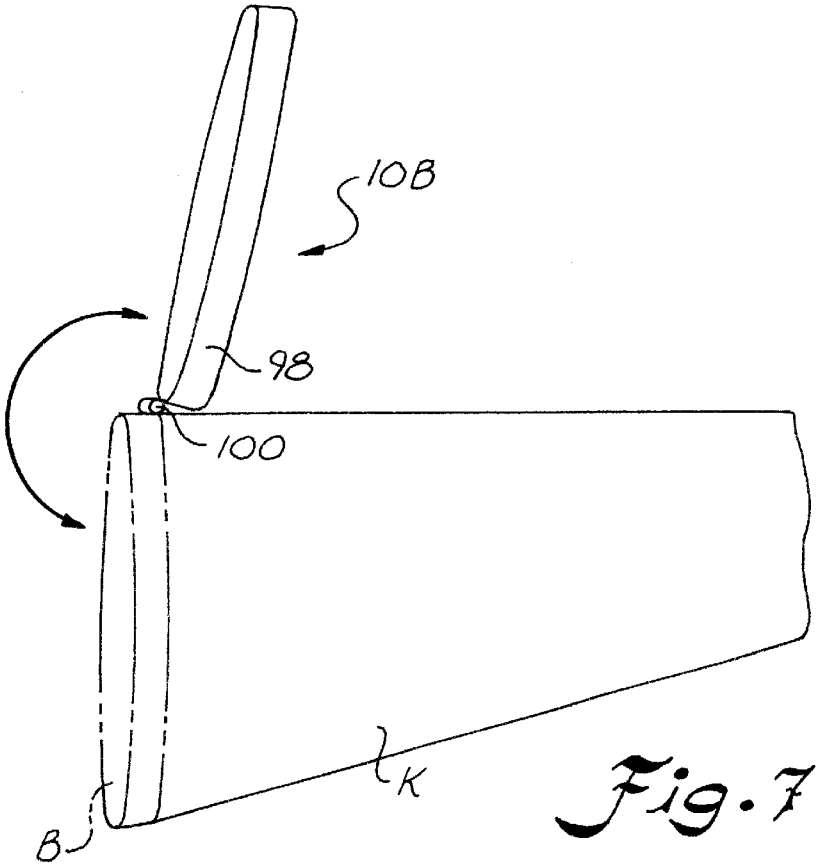
FIGS. 7 through 10 are schematic views of alternate embodiment gun braces constructed in accordance with the present invention.

FIG. 7 illustrates another alternate embodiment of a gun brace constructed in accordance with the present invention. Gun brace 10B includes an arm 98 which is hinged with hinge 100 to the upper portion of butt B of a firearm F. When gun brace 10B is to be used, arm 98 is pivoted to an extended position, as shown in FIG. 7, and locked into place by conventional means such as a screw and threaded fastener (not shown) passing through hinge 100, which would allow arm 98 to be secured into place, and/or through use of the detent mechanism (not shown) using a spring loaded button through hinge 100, which would allow for arm 98 to be locked into place and then quickly released by simply depressing the spring loaded button (not shown).

Figure 8:
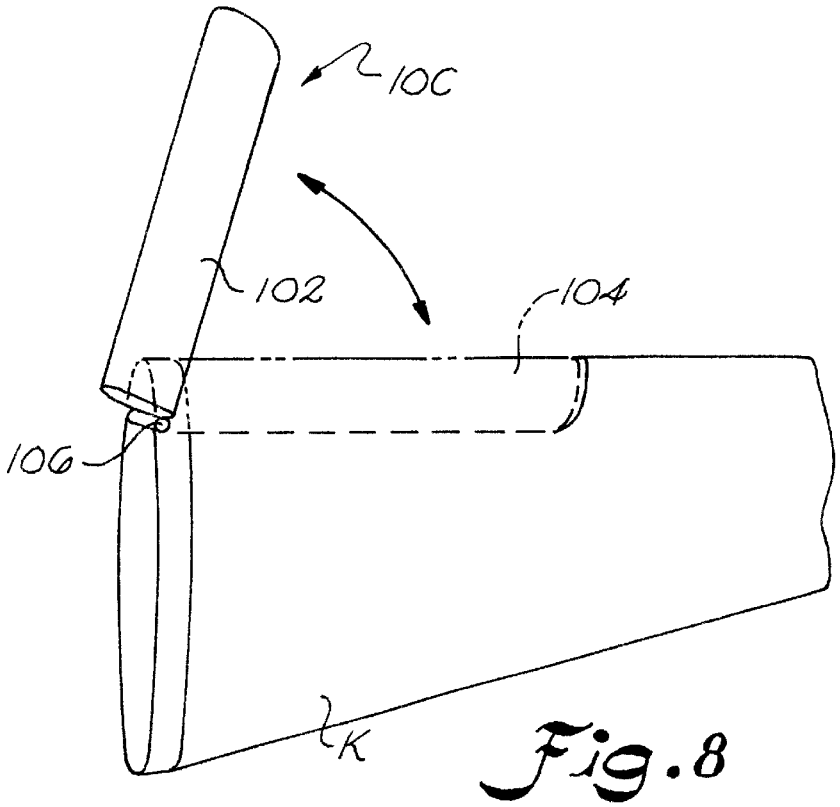

FIG. 8 includes still another alternate embodiment of the present invention, illustrating gun brace 10C. Gun brace 10C includes an arm 102 which is normally received in a recess or cavity 104 of a gun stock, when in its retracted position. When moved to its extended position, arm 102 pivots on a hinge 106. Although not shown, adjustment means similarly as discussed above with gun braces 10, 10A, and 10B could be used to adjust the upward pivoting of arm 102. Alternately, and more simply, hinge 106 could be configured to only allow arm 102 to pivot to a pre-determined amount.

Figure 9:
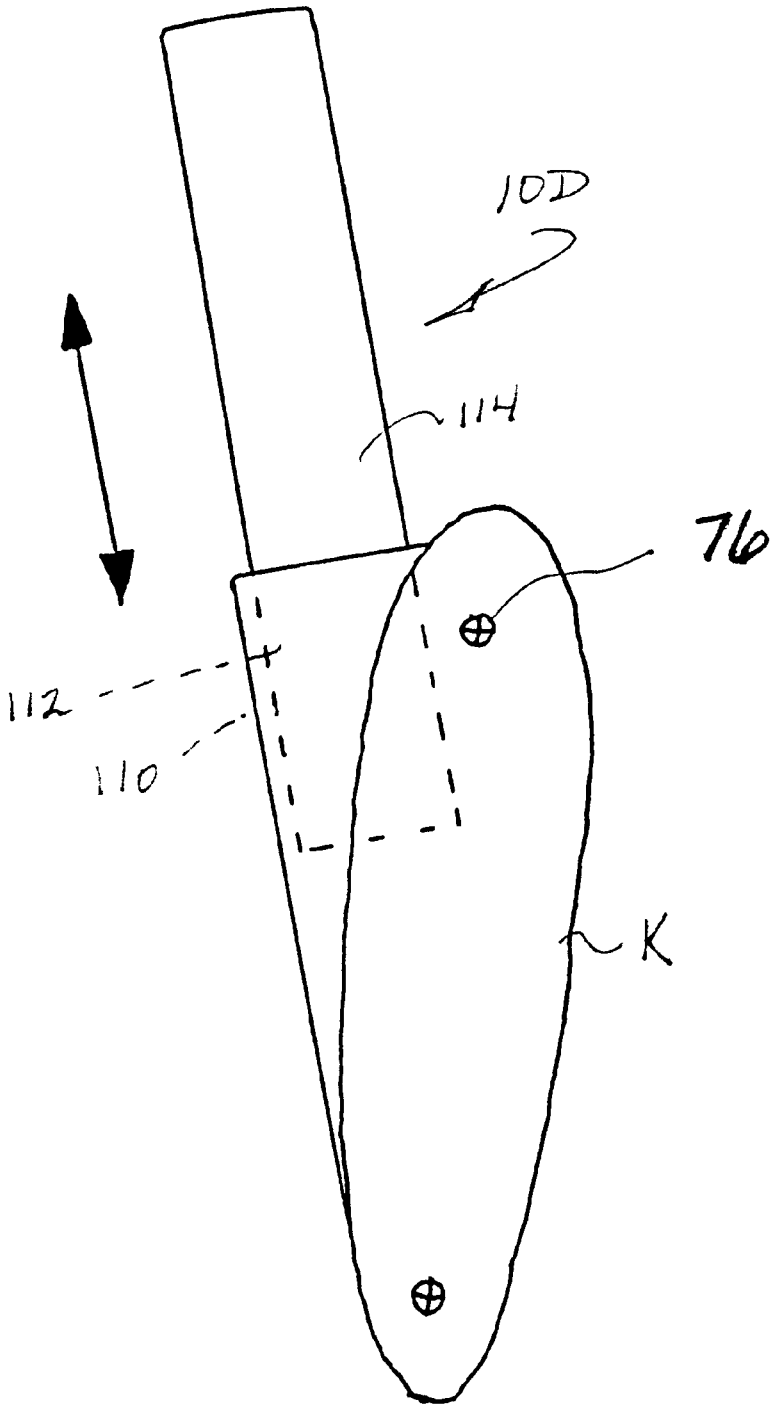

FIG. 9 illustrates alternate embodiment gun brace 10D. In this embodiment, a receiver 110 is built into a side portion of the stock of firearm F. Receiver 110 includes a cavity 112 for receipt of a telescoping arm 114. Arm 114 could simply be pulled into its extended position, as shown in FIG. 9, and twist-locked into place, or, alternately, arm 114 could be spring-loaded such that it was biased towards its extended position. In such a version, arm 114 could be held in its retracted position within receiver 110 by some sort of locking pin, tab, or lever, or some other suitable retention mechanism.

Figure 10:
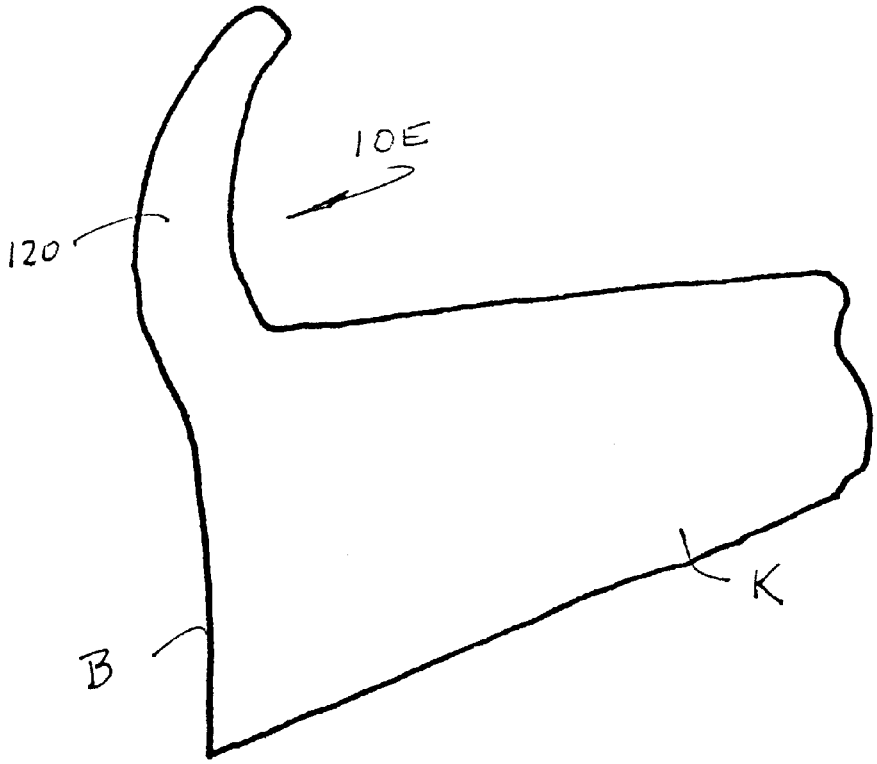

Finally, FIG. 10 shows alternate embodiment of gun brace 10E wherein brace arm 120 is fixedly attached to the upper rear end of the stock, and extends upwardly from the butt B of the firearm.

All of the foregoing embodiments of the present gun brace function to contact the back of the shooter's head or neck region in order to brace the firearm and to support the firearm's weight, as discussed above.

From the foregoing, it can be seen that certain versions of the gun brace of the present invention can be attached to the stock of an ordinary firearm without requiring the drilling of additional holes or using additional fasteners or hardware. Further, such gun brace can be removed easily, without damaging the gun. Moreover, such a gun brace is adjustable for different shooters, preferences and can be maintained on the firearm whether used or not. The spring-loaded brace pad of such a gun brace automatically moves to the proper position for contacting the back of the shooter's head or neck, or both, when the arm is moved from its retracted position. And when in the retracted position, the spring-loaded brace pad bears against the stock in a manner to reduce rattling noises, snagging on underbrush, etc. Further, by providing padding on both sides of the brace pad, the surface of the stock is protected, and a comfortable brace surface is provided for the shooter's use.

It is also to be understood that the gun brace of the present invention can be detachable and can be used for either side of the stock of the firearm to accommodate left-handed and right-handed shooters.

In use, the arm A of gun braces 10 and 10A is pivoted upwardly from the retracted position to the extended position, wherein adjustment screw 38 contacts tang 34. Because brace pad 12 is spring biased to pivot outwardly once arm A is raised sufficient for brace pad 12 to clear stock K, brace pad 12 automatically moves to the bracing position for bracing the firearm F against the back of the shooter's head, neck, or both in order to steady and support the firearm during aiming and firing.

While preferred embodiments of the invention have been described using specific terirts, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A device for allowing a user to support a gun during aiming and firing of the gun, the gun having an elongated stock portion and a butt portion, the device comprising:

a brace member connected to the stock portion of the gun, the brace member extending upwardly from the stock portion of the gun and being configured for contacting at least a portion of the back of the user's head or neck for bracing the gun there against while the user aims and fires the gun.

2. The device as set forth in claim 1, wherein said brace member is connected to the stock portion for movement between an extended position extending upwardly from the stock portion of the gun for contacting the back of the user's head or neck and a retracted position adjacent the stock portion.

3. The device as set forth in claim 1, wherein said brace member is connected to the stock portion for pivotal movement between an extended position extending upwardly from the stock portion of the gun for contacting the back of the user's head or neck and a retracted position adjacent the stock portion.

4. The device as set forth in claim 1, wherein said brace member is connected to the stock portion for generally rectilinear movement between an extended position extending upwardly from the stock portion of the gun for contacting the back of the user's head or neck and a retracted position adjacent the stock portion.

5. The device as set forth in claim 1, wherein said brace member is connected to the stock portion for sliding movement between an extended position extending upwardly from the stock portion of the gun for contacting the back of the user's head or neck and a retracted position adjacent the stock portion.

6. The device as set forth in claim 1, wherein said brace member includes a lower arm portion and an upper arm portion having a pad for contacting the back of the user's head or neck, said upper arm portion being slidably connected to said lower arm portion for movement relative to said lower arm portion.

7. The device as set forth in claim 1, wherein said brace member includes a lower arm portion pivotally connected to the stock portion and an upper arm portion having a pad for contacting the back of the users head or neck, said lower arm portion including an adjustment member for allowing the selective adjustment of pivoting of said lower arm portion, and said upper arm portion being slidably connected to said lower arm portion for movement relative to said lower arm portion.

8. The device as set forth in claim 1, wherein said brace member includes a lower arm portion connected to the stock portion and an upper arm portion connected for movement relative to said lower arm portion, said upper arm portion having a pad for contacting the back of the user's head or neck, and further comprising an adjustment member for allowing the selective adjustment of said upper arm portion with respect to said lower arm portion.

9. The device as set forth in claim 1, wherein said brace member includes a brace pad pivotally connected to said brace member for contacting the back of the user's head or neck.

10. The device as set forth in claim 1, wherein said brace member is connected to the stock portion for movement between an extended position extending upwardly from the stock portion of the gun for contacting the back of the user's head or neck and a retracted position adjacent the stock portion and wherein said brace member includes a brace pad pivotally connected to said brace member for contacting the back of the user's head or neck, said brace pad being spring biased for automatically pivoting to a position for contacting the back of the user's head when said brace member is moved to said extended position.

11. The device as set forth in claim 1, wherein said brace member is hinged to the stock portion for pivotal movement between an extended position extending upwardly from the stock Dortion of the gun for contacting the back of the users head or neck and a retracted position adjacent the stock portion.

12. A device for allowing a user to support a gun during aiming and firing of the gun, the gun having an elongated stock portion and a butt portion, the device comprising:

a brace member connected to the stock portion of the gun, the brace member being extendable upwardly from the stock portion of the gun and being configured for contacting at least the back portion of the user's head or neck for bracing the gun there against while the user aims and fires the gun.

13. The device as set forth in claim 12, wherein said brace member is connected to the stock portion for movement between an extended position for contacting the back of the user's head or neck and a retracted position adjacent the stock portion.

14. The device as set forth in claim 12, wherein said brace member includes a lower arm portion and an upper arm portion having a pad for contacting the back of the user's head or neck, said upper arm portion being slidably connected to said lower arm portion for movement relative to said lower arm portion.

15. The device as set forth in claim 12, wherein said brace member includes a lower arm portion pivotally connected to the stock portion and an upper arm portion having a pad for contacting the back of the user's head or neck, said lower arm portion including an adjustment member for allowing the selective adjustment of pivoting of said lower arm portion, and said upper arm portion being slidably connected to said lower arm portion for movement relative to said lower arm portion.

16. A device for allowing a user to support a gun during aiming and firing of the gun, the gun having an elongated stock portion and a butt portion, the device comprising:

a brace member connected to the stock portion of the gun, the brace member being extendable upwardly from the stock portion of the gun and being configured for contacting at least the back of the user's head or neck for bracing the gun there against while the user aims and fires the gun; and said brace member including a lower arm portion connected to the stock portion and an upper arm portion connected for movement relative to said lower arm portion, said upper arm portion having a pad for contacting the back of the user's head or neck.

17. A method for allowing a user to support a gun during aiming and firing of the gun, the gun having an elongated stock portion and a butt portion, the method comprising:

providing an upwardly extending brace member on the stock portion of the gun; and placing the brace member against the back of the user's head or neck for bracing the gun there against while the user holds the butt portion of the gun against a front portion of the user's body.

* * * * *

UNITED STATES PATENT AND TRADEMARK OFFICE

CERTIFICATE OF CORRECTION

PATENT NO. : 6,250,009 B1
DATED : June 26, 2001
INVENTOR(S) : Michael I. Leontuk It is certified that error appears in the above-identified patent and that said Letters Patent is hereby corrected as shown below:

Column 1,
Line 44, replace "by" with -- of --

Column 5,
Line 49, replace "terirts" with -- terms --

Column 6,
Line 62, replace "Dortion" with -- portion --
Line 62, replace "users" with -- user's --

Signed and Sealed this

Thirteenth Day of November, 2001

*Attest:*

Nicholas P. Godici

*Attesting Officer*

NICHOLAS P. GODICI
*Acting Director of the United States Patent and Trademark Office*